United States Patent [19]

Kikura

[11] 4,264,535

[45] Apr. 28, 1981

[54] FUEL INTAKE SYSTEM FOR MULTI-CYLINDER INTERNAL COMBUSTION ENGINE

[75] Inventor: Katsuaki Kikura, Hiroshima, Japan

[73] Assignee: Toyo Kogyo Co., Ltd., Hiroshima, Japan

[21] Appl. No.: 12,554

[22] Filed: Feb. 15, 1979

[30] Foreign Application Priority Data

| | | | |
|---|---|---|---|
| Feb. 24, 1978 | [JP] | Japan | 53-21255 |
| Mar. 25, 1978 | [JP] | Japan | 53-34365 |
| Mar. 29, 1978 | [JP] | Japan | 53-37106 |

[51] Int. Cl.[2] ..... F02M 3/08

[52] U.S. Cl. ..... 261/23 A; 261/41 D; 261/121 A; 123/52 M

[58] Field of Search ..... 261/23 A, 41 D, 121 A; 123/52 MB

[56] References Cited

U.S. PATENT DOCUMENTS

| | | | |
|---|---|---|---|
| 1,273,845 | 7/1918 | Funderburk | 261/23 A |
| 2,160,922 | 6/1939 | Sullivan | 123/52 MB |
| 2,296,697 | 9/1942 | Ball | 261/23 A |
| 2,358,435 | 9/1944 | Ball | 261/23 A |
| 2,377,852 | 6/1945 | Bliffert | 261/23 A |
| 2,752,132 | 6/1956 | Nye | 261/23 A |
| 2,764,140 | 9/1956 | Stone | 123/52 MB |
| 2,765,780 | 10/1956 | Ostrander | 123/52 MB |
| 3,414,242 | 12/1968 | Bouteleux | 261/41 D |
| 3,454,264 | 7/1969 | Sarto | 261/41 D |
| 3,544,083 | 12/1970 | Currie | 261/23 A |
| 3,698,371 | 10/1972 | Mitsuyama et al. | 261/23 A |
| 3,742,922 | 7/1973 | Hisatomi et al. | 261/23 A |
| 3,814,389 | 6/1974 | August | 261/41 D |
| 3,944,634 | 3/1976 | Gerlach | 261/41 D |
| 3,980,052 | 9/1976 | Noguchi et al. | 261/23 A |
| 4,007,237 | 2/1977 | Nakamura et al. | 261/41 D |

*Primary Examiner*—Tim R. Miles

*Attorney, Agent, or Firm*—Wenderoth, Lind & Ponack

[57] ABSTRACT

For a multi-cylinder internal combustion engine having at least two sets of engine cylinders, a fuel intake system comprises at least first and second intake passages communicated to the engine cylinders of the respective sets and through which respective primary combustible mixtures are supplied into the engine cylinders of the sets. First and second connecting passages are provided for communication between the first and second intake passage at respective positions downstream of throttle valves in the intake passages. The first connecting passage has an intermediate portion communicated to an idle and low-speed fuel circuit for distributing uniformly an idling mixture into the first and second intake passages and has an effective cross sectional surface area smaller than that of the second connecting passage.

5 Claims, 5 Drawing Figures

FUEL INTAKE SYSTEM FOR MULTI-CYLINDER INTERNAL COMBUSTION ENGINE

BACKGROUND OF THE INVENTION

The present invention relates generally to a fuel intake system of a multi-cylinder internal combustion engine and, more particularly, to an improvement in distribution of an air-fuel mixture from an idle and low-speed circuit to a plurality of intake passages.

The present invention is applicable to a multi-cylinder internal combustion engine employing a carburetor of a type having at least two intake barrels connected to respective sets of engine cylinders or combustion chambers.

There is known a multi-cylinder internal combustion engine having a fuel intake system including an air-fuel intake passage for each engine cylinder or each group of the engine cylinders. In this type of multi-cylinder internal combustion engine, since the intake passages are independent from each other, there is no possibility that the air-fuel mixture flowing through one intake passage undesirably interferes with the air-fuel mixture flowing through another intake passage and, therefore, the supply of the air-fuel mixture to the engine cylinder or each group of the engine cylinders can advantageously be steadily effected. However, this type of multi-cylinder internal combustion engine requires the employment of a carburetor for each intake passage.

The employment of one carburetor for each intake passage involves a plurality of adjustments to be performed for each carburetor, which are likely to result in variation in performance between these carburetors. In particular, the idle and low-speed fuel circuit necessary to supply an air-fuel mixture during the idling or low-speed operation of the engine requires a delicate adjustment to provide a proper air-fuel mixing ratio and the failure to achieve this proper mixing ratio in the idle and low-speed fuel circuit is likely to result in fluctuation in engine rotation during the idling, uncomfortable drivability during the low-speed engine operation when the engine is in a vehicle, increased fuel consumption and/or the increased exhaust gas emission.

In order to make it possible to supply air-fuel mixtures of equal mixing ratios to the intake passages, U.S. Pat. No. 3,698,371, patented on Oct. 17, 1972, the invention of which has been assigned to the same assignee of the present invention, discloses the employment of a communication passage extending between the intake passages and having an idle port defined in and positioned intermediately of the communication passage, said idle port having an idle adjustment screw for metering the rate of flow of the air-fuel mixture which is to be supplied into the communication passage from an idle and low-speed fuel circuit. This communication passage has its opposite ends opening into the respective intake passages at a position downstream of the throttle valves in the corresponding intake passages.

The device disclosed in the above mentioned U.S. patent is so designed that, during the idling operation of the internal combustion engine, the air-fuel mixture from the idle and low-speed fuel circuit can be supplied uniformly into the intake passages through the communication passage, thereby substantially eliminating the employment of two idle jet systems, one for each intake passage. This device is advantageous in that no separate and independent adjustment of the idle adjustment screws is required; however, it has been found to have some disadvantages.

In the first place, the manufacture of the device, particularly the machining of the idle port, requires the utmost care and precise adjustments to avoid any possible misalignment of the tapered tip of the idle adjustment screw relative to the idle port which may otherwise result in uneven distribution of the air-fuel mixture into the intake passages. In the second place, in view of the fact that the suction pressure, i.e., the negative pressure, in each of the intake passages varies depending upon the cycle of operation of the piston within the corresponding engine cylinder and the air-fuel mixture itself has a nature tending to cause it to flow from a high pressure region (a low negative pressure region) towards a low pressure region ( a high negative pressure region) due to the effect of a pressure differential like other fluid mediums, the presence of an unbalance in negative pressure between the intake passages which may result from a difference in the opening of the various throttle valves within the respective intake passages results in a larger amount of the air-fuel mixture from the communication passage flowing into one of the intake passages, which has the throttle valve set to a relatively small opening and where a relatively high negative pressure is developed acordingly, than into the other of the intake passages which has the throttle valve set to a relatively large opening and where a relatively low negative pressure is developed accordingly. Therefore, with the device having the construction disclosed in the above mentioned U.S. patent, it is not possible to achieve uniform distribution of the air-fuel mixture into the intake passages through the communication passage.

Although not pertinent to the present invention, Japanese Utility Model Publication No. 52–18342, published on Apr. 25, 1977, the invention of which has been assigned to the same assignee as the present invention, discloses the employment of a by-pass passage extending between the intake passages and having its opposite ends opening towards the respective intake passages at positions downstream of the throttle valves in the intake passages, and a shutter valve installed within one of the intake passages for pivotal movement between closed and opened positions. The device of this Japanese publication is so designed that, only during the deceleration of the internal combustion engine, the shutter valve is brought to the closed position so that substantially the whole amount of the air-fuel mixture flowing in said one of the intake passages can be supplied into the other of the intake passages through the by-pass passage.

The purpose for which the combination of the bypass passage with the shutter valve is employed according to the above mentioned Japanese publication is to substantially eliminate the failure of the air-fuel mixture, supplied into one of the engine cylinders through said other of the intake passages, to ignite, thereby avoiding the possible occurrence of knocking and/or after-burning of exhaust gases.

SUMMARY OF THE INVENTION

The present invention has been made with a view to providing an improved fuel intake system for a multi-cylinder internal combustion engine which can supply an air-fuel mixture uniformly into a plurality of intake passages in communication with at least two sets of engine cylinders, thereby substantially eliminating the disadvantages and inconveniences inherent in the prior art system of a similar kind.

Another important object of the present invention is to provide an improved fuel intake system of the type referred to above, which is effective to substantially eliminate possible variations in the pattern of combustion of the air-fuel mixture occurring in the engine cylinders during the idling or low load operating condition of the engine.

A further object of the present invention is to provide an improved fuel intake system of the type referred to above, which can readily be embodied in a multi-cylinder internal combustion engine, substantially without requiring any complicated operation.

In order to accomplish these and other objects of the present invention, the present invention provides a fuel intake system for a multi-cylinder internal combustion engine having at least first and second sets of engine cylinders, which comprises at least first and second intake passage means each in communication with the engine cylinder of the corresponding set and including a carburetor for combining fuel with air to form a primary combustible mixture, a throttle valve for controlling the rate of delivery of the primary combustible mixture to the engine cylinder and an idle and low-speed fuel circuit for providing an auxiliary combustible air-fuel mixture necessary to enable the engine to be operated at an idling speed. In accordance with the present invention, the fuel intake system of the type referred to above is provided with first and second connecting passage means each extending between the first and second intake passage means at a position downstream of the throttle valves in the respective first and second intake passage means. The first connecting passage means is positioned adjacent to and upstream of the second connecting passage means with respect to the direction of flow of the primary combustible mixture towards the engine cylinders of any set and a portion of the first connecting passage means intermediately of the length thereof is placed in communication with an idle port forming a part of the idle and low-speed fuel circuit. In one preferred embodiment of the present invention, the effective cross-sectional area of the first connecting passage means is sufficiently smaller than that of the second connecting passage means that the substantially biased flow of the auxiliary combustible mixture, supplied into the first connecting passage means, towards one of the first and second intake passage means, which tends to occur when the pressure differential is developed between the first and second intake passage means, can be minimized or substantially eliminated while the second connecting passage means establishes free communication between the first and second intake passage means thereby counterbalancing the pressure differential. For this purpose, it is preferred that the effective cross-sectional area of the first connecting passage means be within the range of one third to one tenth of that of the second connecting passage means, preferably, one fifth thereof.

According to the present invention, because of the employment of the second connecting passage means in combination with the first connecting passage means which has an effective cross-sectional area smaller than that of the second connecting passage means, not only can any possible unbalance in pressure between the first and second intake passage means be minimized or substantially eliminated, but also the auxiliary combustible mixture can be uniformly supplied into the first and second intake passage means. This brings about not only such advantages as achieving a smooth idling of the engine and improved drivability during the low load engine operating condition, but also the advantage of enabling the engine to be operated with a relatively lean combustible mixture which eventually results in the saving of expensive fuel. In practice, the first connecting passage means has a mixing chamber positioned intermediately of the length thereof for facilitating the mixing of fuel, supplied thereto through the idle port, with air to form the auxiliary combustible mixture generally referred to as the "idling mixture."

It is to be noted that the number of engine cylinders in each set need not be limited to one, but may be two or more. Where two or more engine cylinders are employed for each set and where the fuel intake system of the present invention includes only the first and second intake passage means as described, the engine cylinders of one set and those of the other set are fluid-connected to the respective fuel intake passage means through associated intake manifolds as is well known to those skilled in the art. In practice, the number of intake passage means corresponds to the number of sets of engine cylinders, the manner of classification of the engine cylinders of one multi-cylinder internal combustion engine into a plurality of sets being well known to those skilled in the art.

BRIEF DESCRIPTION OF THE DRAWINGS

These and other objects and features of the present invention will become apparent from the following description of preferred embodiments thereof together with the accompanying drawings, in which.

DETAILED DESCRIPTION OF THE INVENTION

Figure 1:
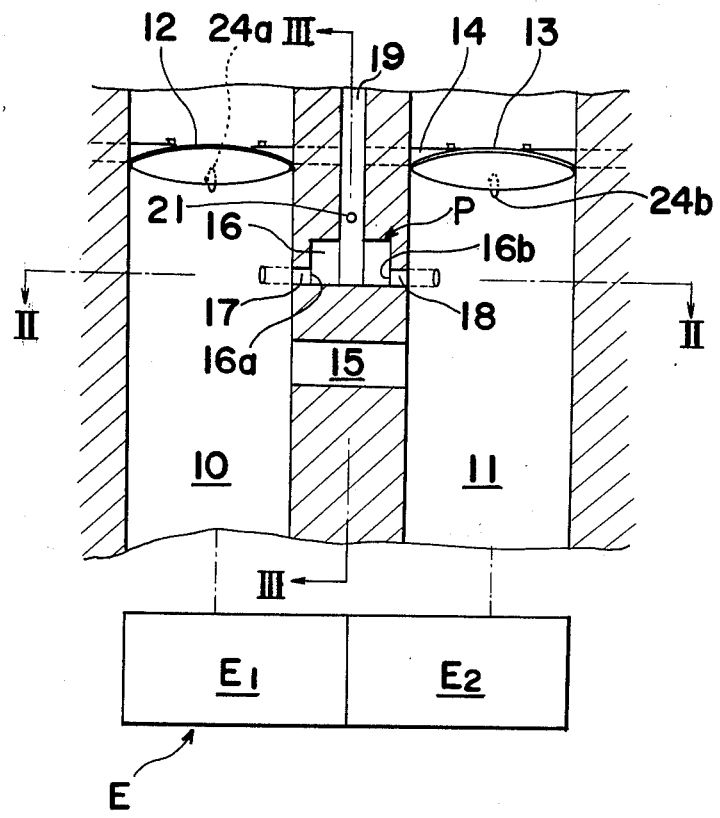
FIG. 1 is a schematic longitudinal sectional view of a fuel intake system of a multi-cylinder internal combustion engine, according to a preferred embodiment of the present invention.

Before the description of the present invention proceeds, it is to be noted that like parts are designated by like reference numerals through the accompanying drawings. It is also to be noted that, for the sake of brevity, the present invention will now be described as applied to an internal combustion engine having two sets of engine cylinders, the number of the engine cylinders in each set being one.

Figure 2:
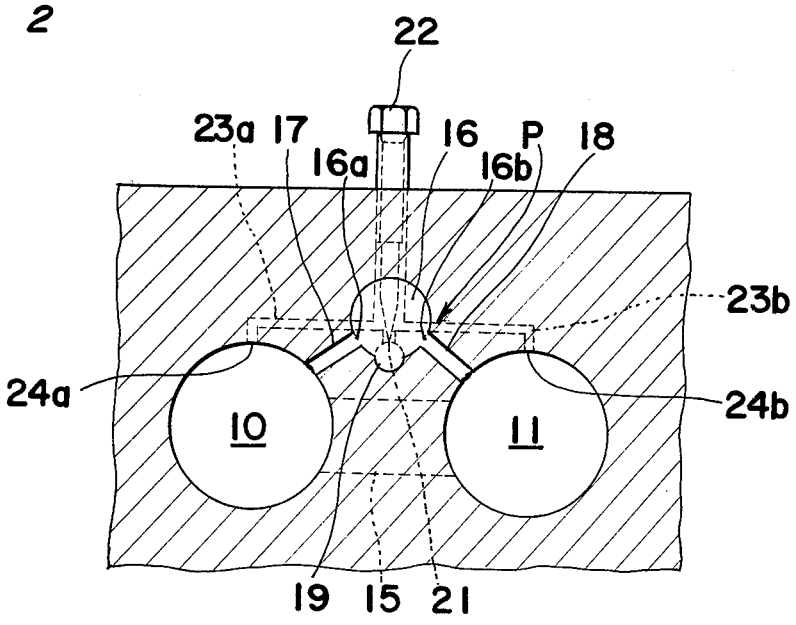
FIG. 2 is a cross sectional view taken along the line II—II in FIG. 1.
Figure 3:
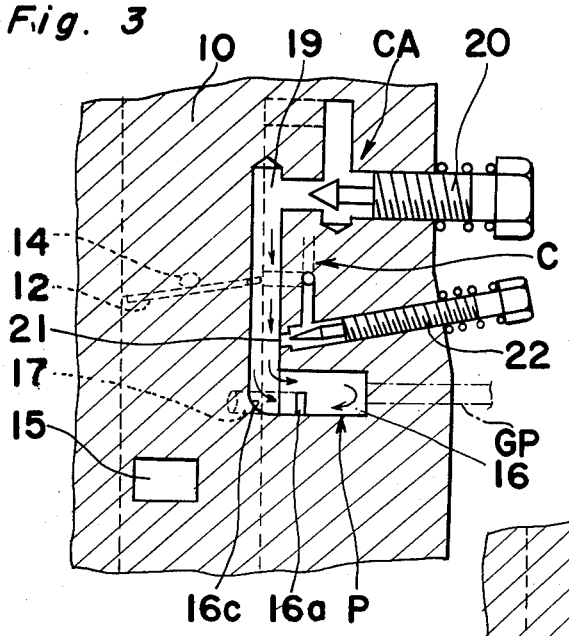
FIG. 3 is a cross sectional view taken along the line III—III in FIG. 1.

Referring first to FIGS. 1 to 3, an internal combustion engine E is shown as having first and second engine cylinders E1 and E2 which may be referred to as combustion chambers. The internal combustion engine E includes a fuel intake system comprising first and second primary intake passages 10 and 11 respectively in communication with the engine cylinders E1 and E2 through corresponding intake manifolds (not shown). Each of the first and second primary intake passages 10 and 11 includes a carburetor CA for combining fuel with air to form a primary combustible mixture, a throttle valve 12 and 13 for controlling the rate of delivery of the primary combustible mixture to the engine cylinders E1 and E2, and an idle and low-speed fuel circuit, generally identified by C in FIG. 3, for providing an auxiliary combustible mixture or idling mixture necessary to enable the engine E to be operated at an idling or low speed.

The throttle valves 12 and 13, generally included in the carburetors, are operatively positioned respectively within the first and second primary intake passages 10 and 11 and are rigidly mounted on a common support shaft 14 for rotation together therewith, the common support shaft 14 being in turn operatively associated with an acceleration pedal (not shown) accessible to an engine operator, such as an automobile driver, for controlling simultaneously the openings of these throttle valves 12 and 13.

The fuel intake system of the present invention further comprises a first connecting passage P, the details of which will be described later, and a second connecting passage 15 extending between the first and second primary intake passages 10 and 11 at a position adjacent to and downstream of the first connecting passage P with respect to the direction of flow of the primary combustible mixture through the primary intake passages 10 and 11 towards the respective engine cylinders E1 and E2. The second connecting passage 15 may have a cross section of any desired shape, but a substantially ellipsoidal or rectangular cross sectional shape is preferred. This second connecting passage 15 serves to establish a free fluid communication between the first and second primary intake passages 10 and 11 for equalizing the pressure in one of the first and second primary intake passages 10 and 11 with that in the other of the first and second primary intake passages 10 and 11 when the engine is in operation. For this purpose, the length of the second connecting passage 15 preferably has the minimum possible value.

The first connecting passage P is constituted by a mixing chamber 16 having a substantially circular cross section when viewed at right angles to the longitudinal axis of any one of the first and second primary intake passages 10 and 11, said mixing chamber 16 having a pair of spaced supply ports 16*a* and 16*b* defined in the peripheral wall of the mixing chamber 16, the peripheral wall together with the top and bottom walls defining the chamber and a pair of supply conduits 17 and 18 of equal lengths. The supply conduit 17 has one end in communication with the supply port 16*a* and the other end opening towards the first primary intake passage 10 at a position downstream of the throttle valve 12 while the supply conduit 18 has one end in communication with the supply port 16*b* and the other end opening towards the second primary intake passage 11 at a position downstream of the throttle valve 13.

An air by-pass passage 19 for by-passing air around either of the throttle valves 12 and 13 has one end in communication with a common source of air upstream of the throttle valves 12 and 13 and the other end connected to the mixing chamber 16. The air by-pass passage 19 includes a by-pass air adjustment screw 20 for controlling the rate of delivery of air flowing therethrough towards the mixing chamber 16 and has an idle port 21 therein at a position adjacent to and downstream of said other end thereof with respect to the direction of flow of the air therethrough towards the mixing chamber 16. The idle port 21 is connected to the idle and low-speed fuel circuit C through an idle adjustment screw 22 adjustably extending generally at right angles to the by-pass passage 19 for controlling the rate of delivery of fuel from the idle and low-speed fuel circuit C towards the by-pass passage 19 by way of the idle port 21. It is to be noted that the idle and low-speed fuel circuit C is in communication with not only the by-pass passage 19 through the idle port 21 by way of the idle adjustment screw 22, but also with the first and second primary intake passages 10 and 11 through branch conduits 23*a* and 23*b* extending from the by-pass passage 19 and opening, in the form of low-speed ports 24*a* and 24*b*, into the respective first and second primary intake passages 10 and 11 at position proximate to the associated throttle valves 12 and 13.

While the mixing chamber 16 forming the second connecting passage P together with the supply ducts 17 and 18 has a substantial volume necessary to achieve a uniform mixing of the fuel supplied through the idle port 21 with the air supplied through the by-pass passage 19 to provide an idling mixture, each of the supply conduits 17 and 18 placing the mixing chamber 16 in communication with the respective first and second primary intake passages 10 and 11 has an effective cross sectional area smaller than that of the second connecting passage 15. Specifically, the cross sectional area of each of the supply conduits 17 and 18 is preferably within the range of one third to one tenth of that of the second connecting passage 15 and, more preferably, one fifth of the latter. By so designing the supply conduits 17 and 18 relative to the second connecting passage 15, it is possible to minimize or substantially eliminate the possibility that the idling mixture within the mixing chamber 16 will, rather than being uniformly distributed into the first and second primary intake passages 10 and 11 through the respective supply conduits 17 and 18, be biased to one of the first and second primary intake passages 10 and 11 where a relatively high negative pressure is developed rather than to the other of the first and second primary intake passages 10 and 11. This is possible because the pressure differential between the first and second primary intake passages 10 and 11 is advantageously compensated for by the second connecting passage 15 due to the fact that the effective cross sectional surface area of the second connecting passage 15 is larger than that of either of the supply conduits 17 and 18.

From the foregoing description, it will readily be understood that, even though the respective openings of the throttle valves 12 and 13 differ from each other by reason of, for example, incorrect mounting of the throttle valves 12 and 13 on the common support shaft 14 or eventual displacement of one of the throttle valves 12 and 13 relative to the other of the throttle valves 12 and 13, any possible unbalance in the amount of suction force between the first and second primary intake passages 10 and 11 will be cancelled. Moreover, any difference in pressure between the first and second primary intake passages 10 and 11 resulting from the different strokes of the pistons in the respective engine cylinders E1 and E2 will also be cancelled by the second connecting passage 15.

Since the pressures respectively in the first and second primary intake passages 10 and 11 are equalized with each other for the reason stated above, the idling mixture formed in the mixing chamber 16 will be uniformly distributed into the first and second primary intake passages 10 and 11 through the supply conduits 17 and 18. It is to be noted that, if the pressures in the respective first and second primary intake passages 10 and 11 are substantially equalized to each other, no inertia force which may cause a biased flow of the idling mixture towards one of the first and second primary intake passages 10 and 11 and which may be created by the presence of the pressure differential between the first and second primary intake passages 10 and 11 does not exist in the first connecting passage P and, therefore, does not act on the idling mixture. The uniform distribution of the idling mixture into the first and second primary intake passages 10 and 11 results in uniform supply of the combustible charges into the engine cylinders E1 and E2, thereby enabling a uniform combustion to occur in all of the engine cylinders E1 and E2.

Furthermore, since the mixing chamber 16 serves to facilitate the mixing of the fuel supplied from the idle port 21 with the air supplied from the by-pass passage 19 prior to the resultant idling mixture being supplied into the first and second primary intake passages 10 and 11, the device of the present invention does not have the disadvantage caused by the displacement of the tapered tip of the idle adjustment screw 22 relative to the idle port 21 or the tendency of the fuel to flow in one direction towards one of the first and second primary intake passages 10 and 11.

Figure 5:
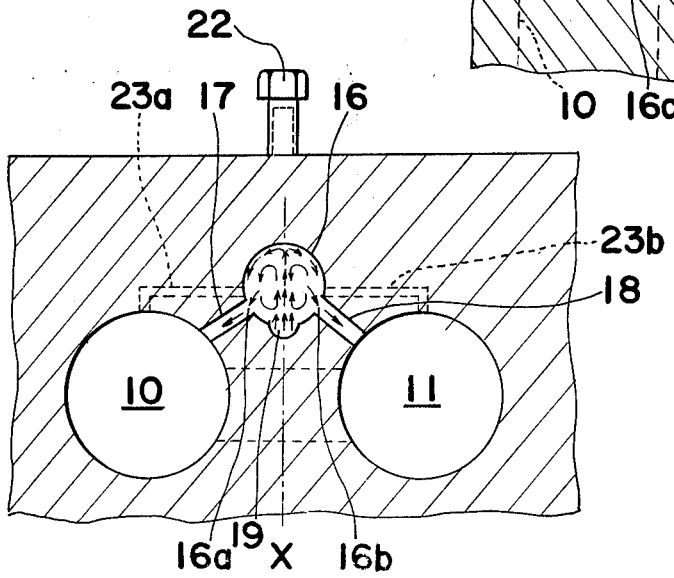
FIG. 5 is a view similar to FIG. 2, showing the pattern of flow of an auxiliary combustible mixture within a mixing chamber in the fuel intake system.

As thus far illustrated, the by-pass passage 19 is shown as extending into the mixing chamber 16 generally at right angles to the plane of the bottom wall of the mixing chamber 16. Should it be necessary to eliminate any turbulent flow of the idling mixture within the mixing chamber 16, a portion of the bottom wall of the mixing chamber 16 which is situated immediately below and aligned with the by-pass passage 19 may be provided with a curved guide **16*c* for enabling the mixture of fuel and air entering the mixing chamber 16 to be deflected in a direction substantially perpendicular to the longitudinal axis of the by-pass passage 19 and towards a portion of the peripheral wall of the mixing chamber 16 opposite to the by-pass passage 19 as shown by the arrows in FIG. 3. By the employment of the curved guide 16*c*, it is possible to facilitate the mixing of the air from the by-pass passage 19 with the fuel from the idle port 21 while flowing within the mixing chamber 16 in a uniform pattern, as shown by the arrows in FIG. 5, which is generally symmetrical with respect to the imaginary axis X passing through the longitudinal axis of the by-pass passage 19 at right angles thereto and in a direction radially of the mixing chamber 16**.

In addition, the supply ports **16*a* and 16*b* defined in the peripheral wall of the mixing chamber 16 are preferably so positioned that the idling mixture flowing towards that portion of the peripheral wall of the mixing chamber 16 opposite to the curved guide 16*c* can be uniformly distributed into the supply conduits 17 and 18 after having impinged upon that portion of the peripheral wall of the mixing chamber 16 and, therefore, divided into two flow components. More specifically, the mixing chamber 16 is preferably so located as to occupy one of the apexes of a geometric equilateral triangle while the other two apexes are occupied by the first and second primary intake passages 10 and 11 and the two sides are occupied by the supply conduits 17 and 18 so that the idling mixture can stay within the mixing chamber for a period of time as long as possible prior to being sucked into the supply ducts 17 and 18 through the supply ports 16*a* and 16*b* by the effect of the negative pressures developed respectively within the first and second primary intake passages 10 and 11**.

In order to avoid the possibility that a fuel component of the idling mixture within the mixing chamber 16 is deposited on the bottom wall of the mixing chamber 16, each of the supply ports **16*a* and 16*b* preferably has a substantially rectangular shape and is at a position adjacent the bottom wall of the mixing chamber 16 with no indentation formed between the bottom wall of the mixing chamber 16 and the corresponding supply port 16*a* or 16*b*. Each of the supply conduits 17 and 18 may have a cross section similar in shape to that of the corresponding supply port 16*a* or 16*b* or a circular cross section. Where the supply conduits 17 and 18 have a circular cross section, the diameter of either of the supply conduits 17 and 18 should be equal to or slightly greater than the maximum diameter of the corresponding supply port 16*a* or 16*b*** so that no indentation will be formed therebetween.

Figure 4:
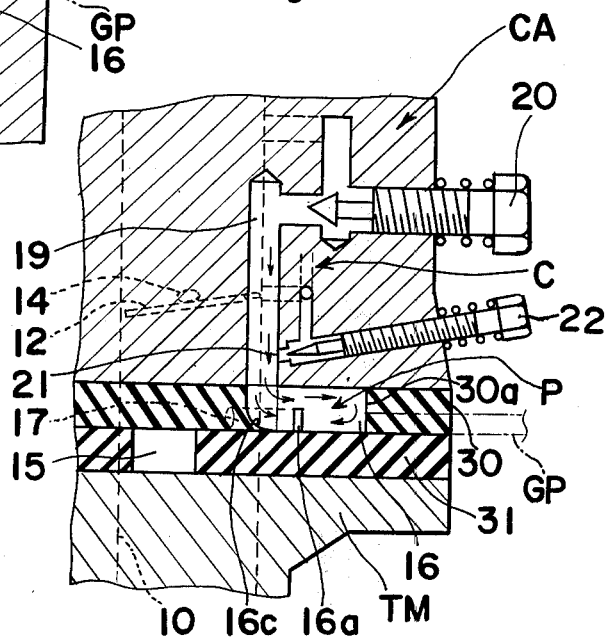
FIG. 4 is a view similar to FIG. 3, showing another preferred embodiment of the present invention.

The idling device having the construction described above has been shown as being built in a block of the carburetor CA. However, in view of the fact that it is a common practice to connect the carburetor CA to the intake manifold IM with gaskets 30 and 31 sandwiched therebetween, it is possible, as shown in FIG. 4, to form the first and second connecting passages P and 15 in the respective gaskets 30 and 31. More specifically, referring to FIG. 4, the mixing chamber 16 is defined by an opening **30*a* in the gasket 30 while the top and bottom walls of the mixing chamber 16 are respectively defined by an end face of the carburetor block and one face of the gasket 31. The supply conduits 17 and 18 can be defined by making corresponding grooves on one face of the gasket 30 opposite to the carburetor block CA and the curved guide 16*c* can also be defined by a portion of the peripheral wall defining the opening 30*a* in the gasket 30. On the other hand, the second connecting passage 15 is defined in the gasket 31 in the form of a substantially elongated opening extending between openings in the gasket 31 which are aligned with the first and second primary intake passages 10 and 11**.

The arrangement shown in FIG. 4 is advantageous in that the machining can readily be carried out without requiring a complicated manufacturing procedure.

Furthermore, it is also possible to connect the mixing chamber 16 to any known source of blow-by gases and/or any known evaporative emission control through a passage, shown by the imaginary line GP for supplying blow-by gases and/or fuel vapors into the first and second primary intake passages 10 and 11 through the mixing chamber 16. Where this passage GP is employed, care must be taken to enable the blow-by gases and/or the fuel vapors to be uniformly mixed with the idling mixture within the mixing chamber 16 and, for this purpose, one end of the passage GP adjacent the mixing chamber 16 should open into the mixing chamber 16 at a position opposite to the curved guide **16*c* so that the flow of the blow-by gases and/or the flow of the fuel vapors entering the mixing chamber 16 counteracts the flow of the idling mixture within the mixing chamber 16**.

Although the present invention has fully been described by way of the preferred embodiments thereof with reference to the accompanying drawings, it is to be noted that various changes and modifications will be apparent to those skilled in the art. For example, although a gasket means sandwiched between the carburetor CA and the intake manifold IM has been described and shown as constituted by the two gaskets 30 and 31, it may be constituted by a single gasket. Such changes and modifications are to be understood as being included within the true scope of the present invention.

What is claimed is:

1. In a fuel intake system for a multi-cylinder internal combustion engine having at least first and second sets of engine cylinders, and having at least first and second primary intake passage means respectively in communication with the engine cylinders of the first and second sets, a carburetor means for combining fuel with air to form a primary combustible mixture to be supplied to the engine cylinders of the first and second sets through the respective first and second primary intake passage means, a plurality of throttle valves equal in number to the number of the primary intake passage means and operatively positioned respectively within the first and second primary intake passage means for controlling the rate of delivery of the primary combustible mixture to the engine cylinders of the first and second sets, and an idle and low-speed fuel circuit for providing an auxiliary combustible air-fuel mixture for enabling the engine to be operated at an idling speed, the improvement which comprises a first connecting passage means extending between said first and second primary intake passage means at a position downstream of the throttle valves with respect to the direction of flow of the primary combustible mixture towards the engine cylinders of the first and second sets, a second connecting passage means extending between the first and second primary intake passage means at a position downstream of said first connecting passage means for establishing a free fluid communication between said first and second primary intake passage means, and a mixing chamber in said first connecting passage means and having a substantial volume and in communication with said idle and low-speed fuel circuit, said idle and low-speed fuel circuit including an air by-pass passage having one end in communication with a source of air and the other end connected to said mixing chamber, a portion of the bottom of said mixing chamber being aligned with the opening of said other end of said by-pass passage and having a curved guide for deflecting the flow of the auxiliary combustible mixture generally at right angles towards a portion of a peripheral wall of said mixing chamber opposite to said curve guide.

2. A system as claimed in claim 1, wherein the effective cross sectional area of said first connecting passage means is within the range of one third to one tenth of the effective cross sectional area of said second connecting passage means.

3. A system as claimed in claim 1, wherein said carburetor means includes gasket means for positioning the carburetor means on an intake manifold of said engine, and said gasket means has said first and second connecting passage means therein.

4. A system as claimed in claim 1, in which said system further has a blow-by gas passage therein having one end in communication with the mixing chamber and the other end adapted to be connected to a source of blow-by gases.

5. A system as claimed in claim 1, in which said system further has a fuel vapor passage therein having one end in communication with the mixing chamber and the other end adapted to be connected to a source of fuel vapors.

* * * * *